US012049731B2

(12) United States Patent
Philipp et al.

(10) Patent No.: US 12,049,731 B2
(45) Date of Patent: Jul. 30, 2024

(54) TRACK MAINTENANCE MACHINE AND METHOD FOR TAMPING SLEEPERS OF A TRACK

(71) Applicant: Plasser & Theurer Export von Bahnbaumaschinen GmbH, Vienna (AT)

(72) Inventors: Thomas Philipp, Leonding (AT); Reinhard Boeck, Aschach an der Donau (AT)

(73) Assignee: Plasser & Theurer Export von Bahnbaumaschinen GmbH, Vienna (AT)

( * ) Notice: Subject to any disclaimer, the term of this patent is extended or adjusted under 35 U.S.C. 154(b) by 392 days.

(21) Appl. No.: 17/275,059

(22) PCT Filed: Sep. 23, 2019

(86) PCT No.: PCT/EP2019/075451
§ 371 (c)(1),
(2) Date: Mar. 10, 2021

(87) PCT Pub. No.: WO2020/083584
PCT Pub. Date: Apr. 30, 2020

(65) Prior Publication Data

US 2022/0056647 A1 Feb. 24, 2022

(30) Foreign Application Priority Data

Oct. 24, 2018 (AT) ..... A 328/2018

(51) Int. Cl.
*E01B 27/16* (2006.01)
*E01B 27/17* (2006.01)
*E01B 27/02* (2006.01)

(52) U.S. Cl.
CPC ..... *E01B 27/16* (2013.01); *E01B 27/17* (2013.01); *E01B 27/02* (2013.01);
(Continued)

(58) Field of Classification Search
CPC ..... E01B 27/16; E01B 27/02; E01B 27/17; E01B 2203/122; E01B 2203/12; E01B 2203/145; E01B 2203/16
(Continued)

(56) References Cited

U.S. PATENT DOCUMENTS 4,040,292 A * 8/1977 Theurer ..... E01B 27/16 73/84
4,312,275 A * 1/1982 Theurer ..... E01B 27/16 104/12
(Continued)

FOREIGN PATENT DOCUMENTS

AT 361 963 B 4/1981
AT 518072 B1 * 7/2017 ..... B06B 1/183
(Continued)

OTHER PUBLICATIONS

International Search Report in Application No. PCT/EP2019/075451 mailed Jan. 3, 2020.
(Continued)

*Primary Examiner* — S. Joseph Morano
*Assistant Examiner* — James William Jones
(74) *Attorney, Agent, or Firm* — Collard & Roe, P.C.; William Collard

(57) ABSTRACT

The invention relates to a track maintenance machine having a tamping unit for tamping sleepers of a track lying in a ballast bed, including a tool carrier which is mounted for vertical adjustment on an assembly frame and on which tamping tools are arranged so as to be squeezable towards one another, wherein the tool carrier is coupled to a vertical
(Continued)

adjustment drive actuated by means of a control device. In this, a control circuit is set up for controlling a lowering motion of the tool carrier, the control circuit including a controller, a setting device for the vertical adjustment drive and a measuring device for recording the lowering motion. With this, it is possible to provide an optimal course for the lowering motion.

12 Claims, 3 Drawing Sheets

(52) U.S. Cl.
CPC ..... *E01B 2203/12* (2013.01); *E01B 2203/122* (2013.01); *E01B 2203/145* (2013.01); *E01B 2203/16* (2013.01)

(58) Field of Classification Search
USPC ..... 104/10–14
See application file for complete search history.

(56) References Cited

U.S. PATENT DOCUMENTS

| | | | | |
|---|---|---|---|---|
| 4,348,901 | A * | 9/1982 | Vural | E01C 19/288 404/133.05 |
| 4,535,700 | A * | 8/1985 | von Beckmann | E01B 27/17 104/12 |
| 4,760,797 | A * | 8/1988 | Stubbs | E01B 27/16 701/19 |
| 9,957,668 | B2 | 5/2018 | Lichtberger | |
| 2007/0250187 | A1 | 10/2007 | Heertjes | |
| 2018/0010302 | A1 * | 1/2018 | Padovani | F04B 51/00 |
| 2020/0181850 | A1 * | 6/2020 | Kopf | E01B 27/17 |
| 2020/0370248 | A1 * | 11/2020 | Maier | E01B 27/16 |
| 2020/0392671 | A1 * | 12/2020 | Stoff | B06B 1/045 |

FOREIGN PATENT DOCUMENTS

| | | | | |
|---|---|---|---|---|
| BE | 881893 | A * | 6/1980 | E01B 27/16 |
| CN | 101059658 | A | 10/2007 | |
| CN | 105189868 | A | 12/2015 | |
| CN | 107419625 | A | 12/2017 | |
| DE | 29 46 737 | A1 | 9/1980 | |
| EP | 0057030 | A1 * | 1/1982 | |
| JP | S51149605 | A | 12/1976 | |
| WO | 2014/127393 | A1 | 8/2014 | |

OTHER PUBLICATIONS

Austrian Search Report in Austrian Application No. A 328/2018 dated Oct. 24, 2018.

* cited by examiner

TRACK MAINTENANCE MACHINE AND METHOD FOR TAMPING SLEEPERS OF A TRACK

CROSS REFERENCE TO RELATED APPLICATIONS

This application is the National Stage of PCT/EP2019/075451 filed on Sep. 23, 2019, which claims priority under 35 U.S.C. § 119 of Austrian Application No. A 328/2018, filed on Oct. 24, 2018, the disclosure of which is incorporated by reference. The international application under PCT article 21(2) was not published in English.

FIELD OF TECHNOLOGY

The invention relates to a track maintenance machine having a tamping unit for tamping sleepers of a track lying in a ballast bed, including a tool carrier which is mounted for vertical adjustment on an assembly frame and on which tamping tools are arranged so as to be squeezable towards one another, wherein the tool carrier is coupled to a vertical adjustment drive actuated by means of a control device. Additionally, the invention relates to a method for operating a corresponding track maintenance machine.

PRIOR ART

A track maintenance machine equipped with a tamping unit is used to produce or stabilize a desired track position. During this, the tamping machine travels on the track and lifts the track grid formed of sleepers and rails to a target level by means of a lifting-/lining unit. Fixation of the new track position takes place by tamping the sleepers by means of the tamping unit. To that end, tamping tools (tamping tines) are set in vibrations, lowered at both sides of a sleeper into the ballast bed and squeezed towards one another in order to consolidate the ballast under the sleeper. Subsequently, the tamping tools are lifted out of the ballast bed again and moved apart. The tamping unit is positioned above the next sleeper and a new tamping cycle begins.

Various solutions are known for lowering and lifting the tamping tools. For example, EP 1 233 108 A1 describes a lifting- and lowering mechanism for a tamping unit in which a hydraulic cylinder and a lever arrangement are coupled to an assembly frame. A tamping unit having several tool carriers is known from EP 0 698 687 A1. In this, an individual vertical adjustment drive is associated with each tool carrier for separate lowering and lifting.

As a rule, for pre-setting the lowering motion, an operator has up to three speed levels to choose from in order to take into account the state of the ballast bed. In the case of a newly laid track, the lowering usually takes place with a slower speed than in a ballast bed which is hardened as a result of wear and environmental influences. The aim is to quickly reach a prescribed penetration depth with a lowering time which is as constant as possible. A corresponding pre-setting takes place by manual adjustment and is based on the experience of the operator.

AT 519 195 A1 discloses a tamping unit in which the lowering motion of the tamping tools is super-imposed by a vertical vibration in order to facilitate a penetration of the tamping tools into a hardened ballast bed. During this, however, an additional stressing of the track maintenance machine is also taken into account since the vertical vibration is also transmitted to a machine frame to which the tamping unit is fastened.

SUMMARY OF THE INVENTION

It is the object of the invention to develop further a track maintenance machine of the type mentioned at the beginning, so that the tamping tools of the tamping unit can be lowered into a ballast bed in an optimized way. in addition, a correspondingly optimized method of operation of the track maintenance machine shall be indicated.

According to the invention, these objects are achieved by way of the features of claims 1 and 6. Advantageous further developments become apparent from the dependent claims.

The invention provides that a control circuit is set up for controlling a lowering motion of the tool carrier, the control circuit including a controller, a setting device for the vertical adjustment drive and a measuring device for recording the lowering motion. With this, it is possible to provide an optimal course for the lowering motion. This concerns an acceleration as well as a penetrating speed when the tamping tines hit the ballast bed, and a braking process when reaching the penetration depth. With the regulating, individual phases of the lowering motion can be matched to one another, so that there is overall a minimal lowering time with concurrent protection of the track maintenance machine and the ballast bed.

Advantageously, the measuring device includes a position sensor for recording a vertical position of the tool carrier. A corresponding control variable of the control circuit can be pre-set in a simple manner and leads to a stable control. Alternatively, or additionally, a speed or an acceleration of the tool carrier or the tamping tools can be recorded.

It is further advantageous if a pre-control or a pre-filter is installed upstream of the controller, by means of which a command variable of the control circuit can be adjusted. In this, the pre-control or the pre-filter uses a mathematical model with adjustment parameters for an optimized control of the setting device in order to follow a prescribed course of the lowering motion with minimized deviations.

In an advantageous embodiment of the invention, the vertical adjustment drive comprises a hydraulic cylinder having a hydraulic valve as a setting device. Hydraulic cylinder and hydraulic valve allow an optimal control of the lowering motion and the lifting motion with short cycle times and delivering great forces.

The hydraulic valve is favourably designed as a pre-controlled regulating valve. In this, a high-dynamic and high-precision drive of a pre-control valve enables an optimal control of the main stage with sufficiently high flow-through capacity. As an alternative, a servo valve or a proportional valve may be used.

In the method according to the invention for tamping sleepers of a track, lying in a ballast bed, by means of a track maintenance machine described above, the tamping unit is positioned above a tamping location of the track and the tool carrier is lowered via the vertical adjustment drive with the tamping tools penetrating into the ballast bed, wherein the lowering motion is carried out with a controlled motion variable.

In order to minimize control deviations when controlling the lowering motion, it is advantageous if a command variable is modified by means of a pre-control installed upstream of the controller, or by means of a pre-filter installed upstream of the controller.

An advantageous further development of the method provides that a control difference occurring during a tamping cycle is fed to a computing unit, and that—based on the control difference—at least one parameter of the pre-control or of the pre-filter is adjusted in the computing unit by means of an iterative learning control algorithm. Thus, an automatic reaction to condition changes of the ballast bed takes place, wherein the control interventions for successive tamping cycles are minimized.

Favourably, the lowering motion of the tool carrier is recorded by means of a position sensor. The latter is either arranged on the tamping unit or at another place on the track maintenance machine from which a contactless detection of the lowering motion is possible.

For a stable control, it is advantageous if a command variable depending on a lowering time is prescribed to the control circuit. Then, a function over the time can be generated as a prescribed course of a lowering motion.

In this, it is useful if a lowering path over the lowering time is prescribed as a command variable to the control circuit. In a corresponding time-path curve, a desired braking course and the intended penetration depth can be indicated directly.

In an advantageous further development, a target value progression is prescribed by means of a target value encoder. With this, an automatized specifying of the command variable is possible. For example, different target value progressions are stored in the target value encoder, and a selection takes place by means of an intelligent control under the assumption of a track parameter or several parameters. During this, the prescription of parameters or of a target value progression by an operator can also be useful.

It is further advantageous if a return variable of the control circuit is fed to the target value encoder designed as a target value generator, and if the prescribed lowering motion is adjusted in dependence on the return variable. In this, the return variable is the measured control variable and allows conclusions as to the condition of the ballast bed. For example, a highly compacted ballast bed can have the effect that a prescribed penetration depth is not being attained despite controlling. Then, the target value generator prescribes to the control circuit a lowering motion with a higher penetration speed. In this way, the available adjustment range of the setting device is always utilized optimally.

Also, an improved method provides that at least one of the variables processed in the control circuit is fed to an evaluation device, and that a parameter for the ballast bed is derived from the at least one variable by means of the evaluation device. In particular, the adjustment variable, the return variable or the control difference allow conclusions as to a penetration behaviour of the ballast bed, from which a condition parameter of the ballast bed ensues.

BRIEF DESCRIPTION OF THE DRAWINGS

The invention will be described below by way of example with reference to the accompanying drawings. There is shown in a schematic manner in.

DESCRIPTION OF THE EMBODIMENTS

Figure 1:
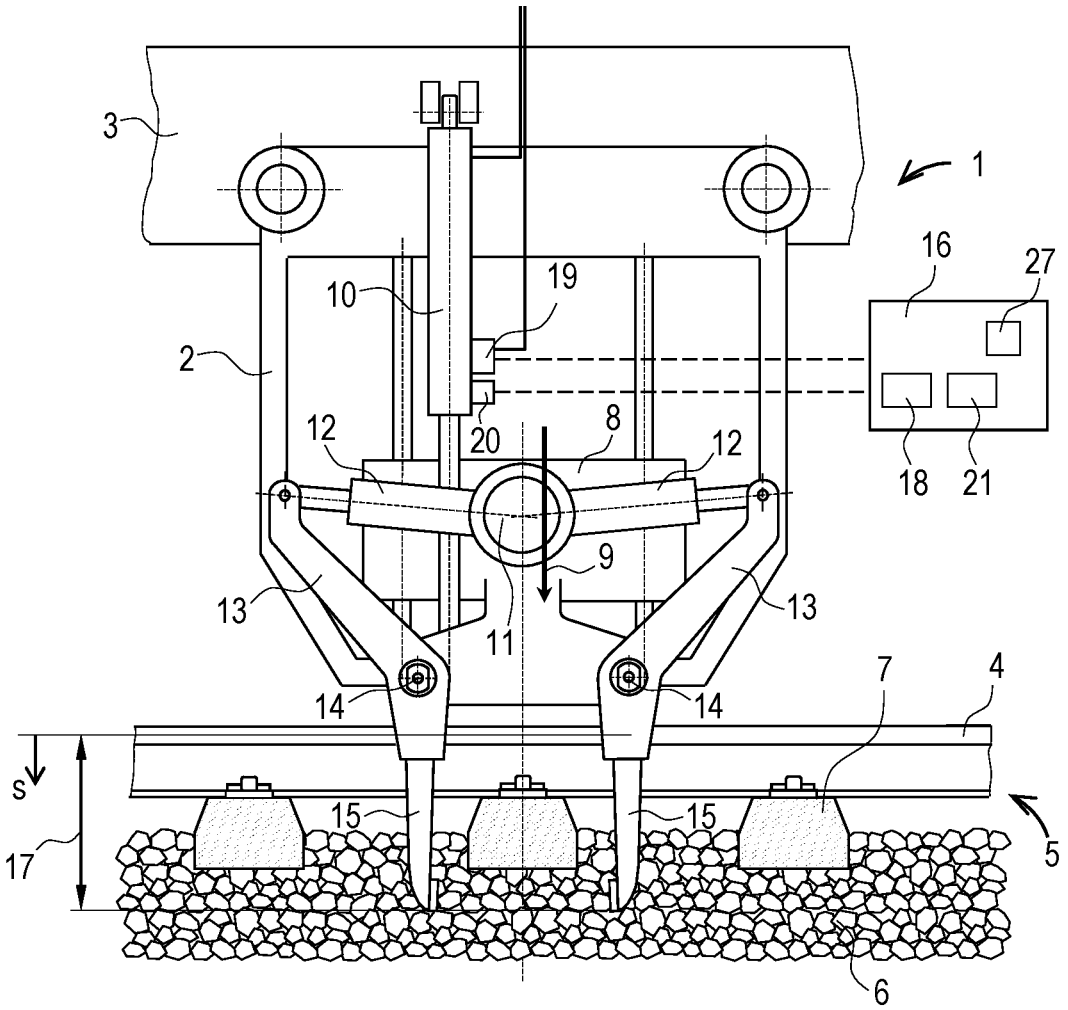
FIG. 1 a tamping unit in a side view

The tamping unit 1 shown in FIG. 1 comprises an assembly frame 2 which is fastened to a machine frame 3 of a track maintenance machine mobile on rails 4 of a track 5. The tamping unit 1 serves for tamping a ballast bed 6 on which sleepers 7 are supported, the rails 4 being fastened thereon. A tool carrier 8 is guided for vertical adjustment in the assembly frame 2, wherein a lowering motion 9 or a lifting motion takes place by means of an associated vertical adjustment drive 10.

Arranged on the tool carrier 8 is a vibration drive 11 to which two squeezing drives 12 are connected. Each squeezing drive 12 is connected to a pivot lever 13. Both pivot levers 13 are supported on the tool carrier 8 so as to be mobile towards one another about a pivot axis 14, horizontal in each case, and have tamping tools 15 (tamping tines). The drives 10, 11, 12 are actuated by means of a control device 16.

During a tamping procedure, the free ends of the tamping tools 15 (tine plates) penetrate into the ballast bed 6 up to a lower sleeper edge and consolidate the ballast underneath the respective sleeper 7. FIG. 1 shows the tamping unit 1 during such a phase of the tamping procedure. Subsequently, the tamping tools 15 are reset and lifted from the ballast bed 6. The tamping unit 1 is moved to the next sleeper 7, and a new tamping cycle starts with a lowering motion 9.

In an optimized lowering motion 9, the desired penetration depth 17 of the tamping tools 15 is reached as fast as possible, wherein however the occurring forces do not subject the track maintenance machine to any disruptive stresses. Additionally, the penetration depth 17 should be reached precisely and should not be exceeded in order not to damage either the sleepers 7 or a formation located under the ballast bed 6.

Figure 2:
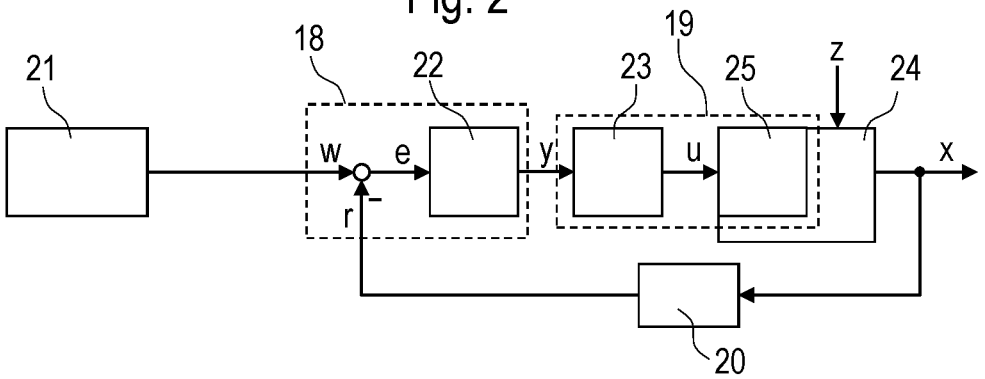
FIG. 2 a control circuit
Figure 3:
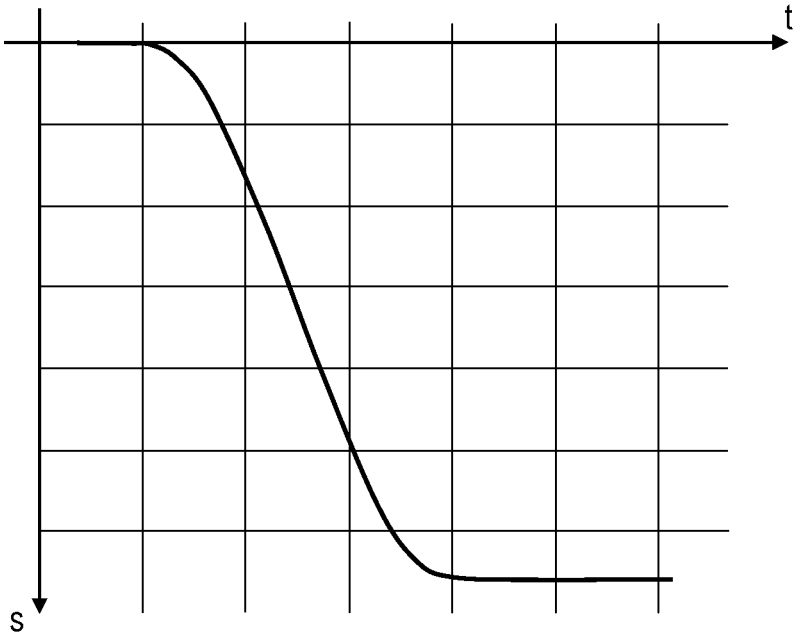
FIG. 3 a command variable progression

This optimized lowering motion 9 is attained, according to the invention, by way of a control circuit set up in the track maintenance machine, having a controller 18, a setting device 19 for the vertical adjustment drive 10, and a measuring device 20 for recording the lowering motion 9 (FIG. 2). In order to pre-set the progression of the lowering motion 9, a target value encoder 21, for example, provides a target value progression for a control variable x, shown in FIG. 3. In this, several target value progressions may also be stored in the target value encoder 21. A selection takes place by means of an intelligent control with assumption of at least one track parameter, or by means of an operator. The output of the target value encoder 21 serves as command variable w of the control circuit. Provided as control variable x is, for example, a lowering path s of the tool carrier 8. The speed and/or the acceleration of the tool carrier 8 can also be used as control variable x.

The controller 18 comprises a control element 22 and delivers a controller output variable y which is fed to a regulator 23 for generating a regulating variable u. As setting device 19 serves, for example, a pre-controlled regulating valve for a hydraulic cylinder of the vertical adjustment drive 10. The regulator 23 is then a setting drive of this pre-controlled regulator valve and, as control variable u, controls an adjustment path of the regulating valve. A present control path 24 comprises, as setting element 25, the valve body of the regulating valve and all other components influencing the lowering motion 9. These include the hydraulic cylinder of the vertical adjustment drive 10 and all lowered components of the tamping unit 1 as well as components of the treated region of the track 5. In particular, the masses of the lowered components and the penetration resistance of the ballast bed 6 come into effect here.

The control output variable y emitted by the control element 22 is based on a control difference e which results from the command variable w minus a return variable r. In this, the return variable r is the control variable x recorded by the measuring device 20. Specifically, the controller 18 determines from a difference between a target value (numerical value of the command variable w) and an actual value (numerical value of the measured control variable x) a numerical adjustment variable (numerical value of the control output variable y) which is prescribed to the regulator 23.

Disturbance variables z act on the control path 24. These are, for example, in particular a change of the penetration resistance as a result of a changing quality of the ballast bed 6. The disturbance of the control variable x caused by a changing penetration resistance yields a control difference e. The adjustment variable u delivered thereupon by the controller 18 and the regulator 23 causes a changed actuation of the vertical adjustment drive 10, thus counteracting the disturbance.

For example, if the tamping tools 15 penetrate into the ballast bed 6 too fast, a force acting from the vertical adjustment drive 10 on the tool carrier 8 is reduced. If penetration is too slow, the force is increased. In this manner, the lowering motion 9 in the case of target deviations is always readjusted to the prescribed command variable w. In this, the tamping tools 15 penetrate into the ballast bed 6 with optimal speed and reach exactly the desired penetration depth 17. In addition, the penetration time is kept constant in the individual tamping cycles.

Figure 4:
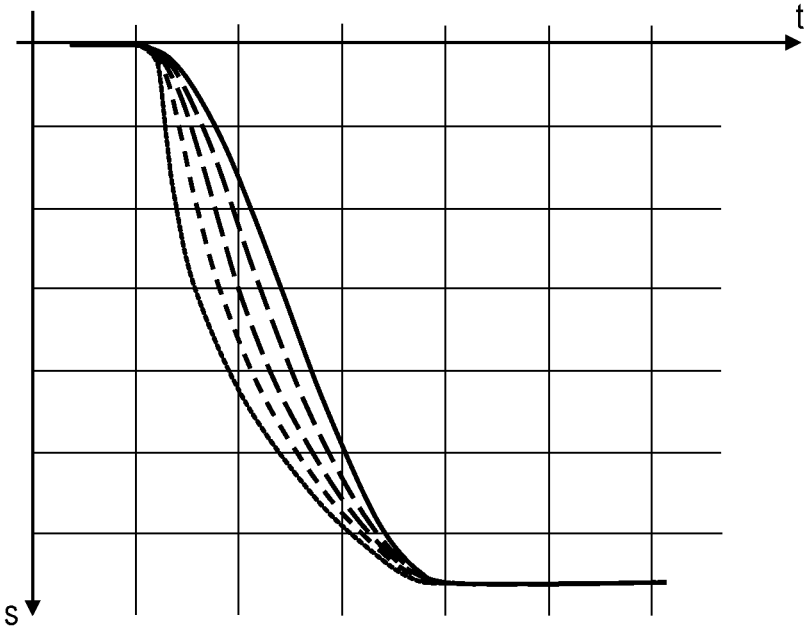
FIG. 4 modified command variable progressions
Figure 5:
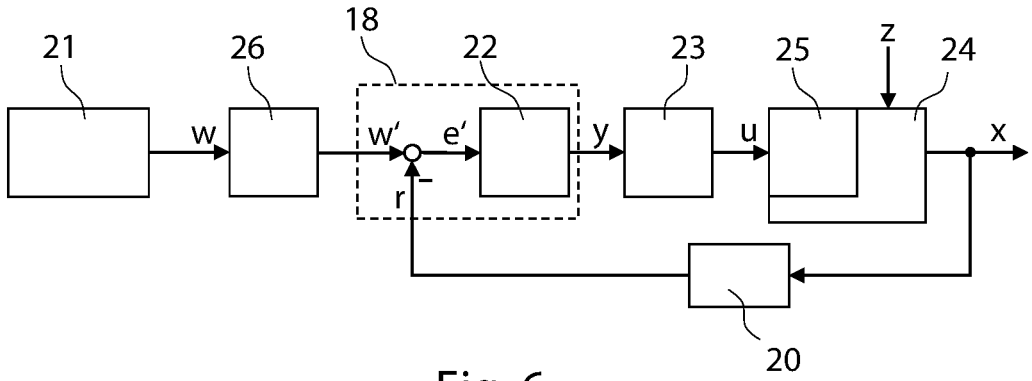
FIG. 5 a control circuit with pre-filter or pre-control

In order to minimize the interventions of the control, it is useful to provide a pre-control or a pre-filter 26 for the command variable w (FIG. 5). The objective of this measure is a modified control variable w' which anticipates the circumstances of the control path 24. For example, a changed curve progression is prescribed for the lowering path s over time t, specified as control variable x, as shown in FIG. 4. The system consisting of tamping unit 1 and treated track 5 then follows this modified command variable specification almost without any control interventions.

In this, the progression drawn in a solid line is intended for a soft ballast bed 6 with only slightly compacted ballast. The further progressions correspond to specifications for a progressively consolidated ballast bed 6, up to the progression drawn in a dotted line for a very highly compacted ballast bed 6. In order to reach the desired penetration depth 17 here within the intended time, a higher speed is required in the starting phase of penetration.

Figure 6:
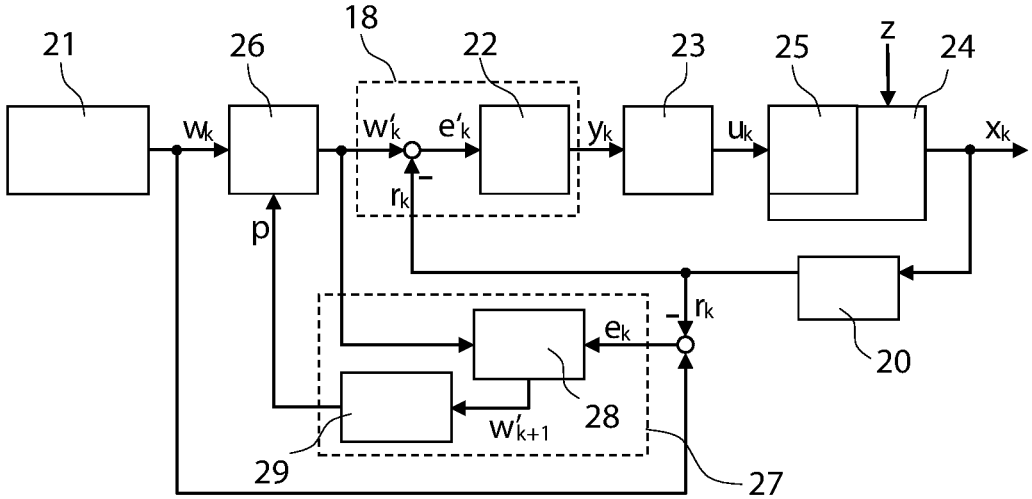
FIG. 6 a control circuit with adjustable pre-filter or adjustable pre-control FIG. 7 a control circuit with target value generator for generating a changed command variable progression

A further improvement stipulates a parameter adjustment of the pre-control or the pre-filter 26, as shown in FIG. 6. To that end, a computer unit 27 is provided to which a control difference $e_k$ occurring during a tamping cycle k is fed. This control difference $e_k$ results from the non-modified command variable $w_k$ minus the return variable $r_k$.

In the computer unit 27, a so-called iterative learning control algorithm 28 is set up. This is used to derive in advance an optimized modified command variable $w'_{k+1}$ for the next tamping cycle k+1 by means of the control difference $e_k$ and the modified command variable $w'_k$ of the viewed tamping cycle k. For this computation, several past tamping cycles with the control differences e occurring in the process may also be used.

In a next step, so that the optimized modified command variable $w'_{k+1}$ comes into effect, the adjustment parameters of the pre-control or the pre-filter 26 are changed. To that end, a corresponding adjustment algorithm 29 is set up in the computer unit 27. The changed pre-control or the changed pre-filter 26 causes a reduction of the control activity, as a result of which the control as a whole becomes more stable. Starting conditions for the iterative learning control algorithm 28 are prescribed either by an operator, or an assumption is made by means of an intelligent control. The iterative adjustment of the parameters then starts from this assumption. In a simple variant, the same initial conditions are always assumed.

Figure 7:
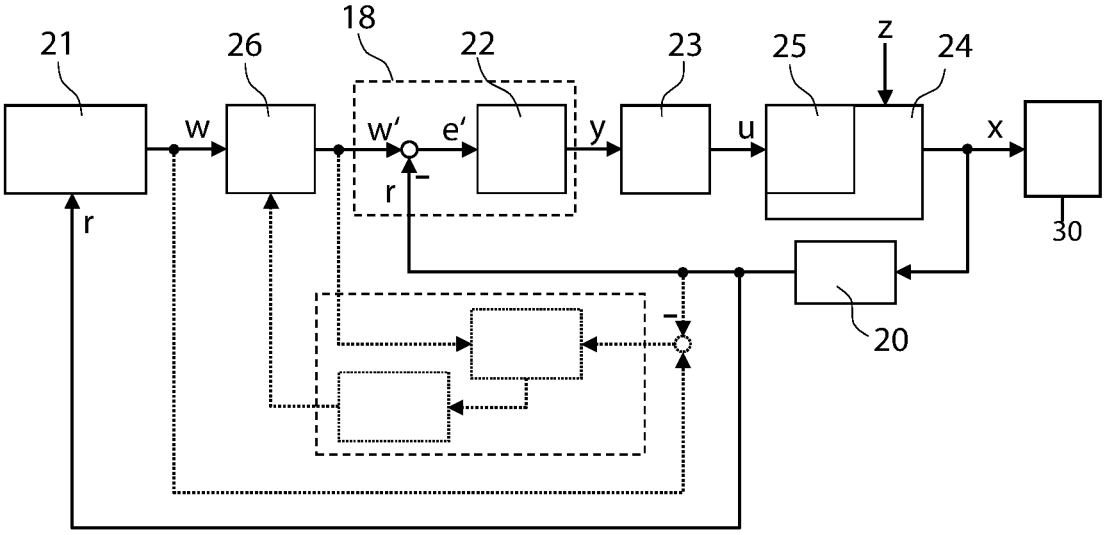

A further improvement is explained with reference to FIG. 7. Here, the target value encoder 21 is designed as a target value generator. Similar to a trajectory generator, this target value generator generates a progression of the lowering motion 9, for instance as a progression of the lowering path s over the time t. In this manner, the target value generator delivers the command variable w to the regulator 18 or to the pre-control or pre-filter 26. In addition, the return variable r is fed to the target value generator in order to record deviations from the command variable w. Here also, initial conditions are prescribed either by an operator or by an intelligent control on the basis of assumed track parameters.

Increasing deviations indicate that the controlling reaches its limits since the generated command variable w can no longer be attained. As soon as the deviations have reached a level which cannot be neglected anymore, the target value generator generates a new specification for the lowering motion 9. For example, a limit value for allowable deviations is pre-set, so that the target value generator generates a new progression of the lowering path s over the time t upon reaching the limit value. In this manner, there is an automatic reaction to a changed quality of the ballast bed 6 without impairing the stability and precision of the control.

The target value generator can also be used at the beginning of a working operation in order to prescribe a starting progression of the lowering motion 9. In this, it is favourable if several trial tamping operations are carried out in order to adjust the specifications for the control to the prevailing conditions.

The electronic components of the control, especially the value encoder 21, the regulator 18 and, optionally, the computer unit 26 are set up in a separate electronic circuit or integrated in the control device 16. The measuring device 10 is arranged, for example, directly at the vertical adjustment drive 10, wherein a hydraulic cylinder with integrated path measurement is useful.

Furthermore, in an expanded embodiment, an evaluation device 30 is provided to which at least a variable u, e, r of the control circuit is fed in order to derive a parameter for the ballast bed 6. Such a parameter indicates, for example, whether new ballast or highly compacted and soiled ballast is present.

The invention claimed is:

1. A track maintenance machine comprising:

a tamping unit for tamping sleepers of a track lying in a ballast bed, an assembly frame;

tamping tools;

a vertical adjustment drive;

a tool carrier which is mounted for vertical adjustment on said assembly frame and on which said tamping tools are arranged so as to be squeezable towards one another, wherein the tool carrier is coupled to said vertical adjustment drive a control device, configured for actuating said vertical adjustment drive, wherein the control device comprises:

a control circuit which is set up for controlling a lowering motion of the tool carrier, the control circuit including a controller, a setting device for the vertical adjustment drive and a measuring device for recording the lowering motion;

wherein the control circuit is provided with a computing unit and wherein a pre-control comprising a filter is installed upstream of said controller by means of which a command variable (w) can be adjusted wherein a computer unit is iterative control algorithm is set up.

2. The track maintenance machine according to claim 1, wherein the measuring device includes a position sensor for recording a vertical position of the tool carrier.

3. The track maintenance machine according to claim 1, wherein the vertical adjustment drive comprises a hydraulic cylinder having a hydraulic valve as a setting device.

4. The track maintenance machine according to claim 3, wherein that the hydraulic valve is designed as a pre-controlled regulating valve.

5. The method for operation of a track maintenance machine according to claim 1, wherein the tamping unit is positioned above a tamping location of the track, and wherein the tool carrier is lowered via the vertical adjustment drive with the tamping tools penetrating into the ballast bed, and the lowering motion is carried out with a controlled motion variable and wherein a command variable is modified by means of a pre-control installed upstream of the controller or by means of a pre-filter installed upstream of the controller.

6. The method according to claim 5, further comprising the steps of feeding a control difference occurring during a tamping cycle to a computing unit, and adjusting at least one parameter of the pre-control or pre-filter based on the control difference in the computing unit by means of an iterative learning control algorithm.

7. The method according to claim 5, wherein the lowering motion of the tool carrier is recorded by means of a position sensor.

8. The method according to claim 5, wherein a command variable depending on a lowering time is prescribed to the control circuit.

9. The method according to claim 8, wherein a lowering path over the lowering time is prescribed as a command variable to the control circuit.

10. The method according to claim 5, wherein a target value progression is prescribed by means of a target value encoder.

11. The method according to claim 10, wherein a return variable of the control circuit is fed to the target value encoder designed as a set-point generator, and wherein the prescribed lowering motion is adjusted in dependence on the return variable.

12. The method according to claim 5, wherein at least one of the variables comprises a disturbance variable stored in the computing unit wherein said disturbance variable is configured to act on the control path to result in a change of the penetration resistance as a result of a changing quality of the ballast bed.

* * * * *